US006685025B1

(12) United States Patent
Kari

(10) Patent No.: US 6,685,025 B1
(45) Date of Patent: Feb. 3, 2004

(54) CARTRIDGE INSERT WHICH FITS INTO A BOX

(75) Inventor: David F. Kari, Bensenville, IL (US)

(73) Assignee: Fidelity Container Corporation, Elk Grove Village, IL (US)

( * ) Notice: Subject to any disclaimer, the term of this patent is extended or adjusted under 35 U.S.C. 154(b) by 87 days.

(21) Appl. No.: 09/921,091

(22) Filed: Aug. 2, 2001

(51) Int. Cl.[7] ..... B65D 81/02
(52) U.S. Cl. ..... 206/583; 206/592
(58) Field of Search ..... 206/521, 583, 206/588, 591, 592, 594, 784; 229/120.37

(56) References Cited

U.S. PATENT DOCUMENTS 1,039,026 A * 9/1912 Carter ..... 206/588
3,921,890 A * 11/1975 Reihm ..... 206/588
5,467,875 A * 11/1995 Sato ..... 206/588
5,772,025 A * 6/1998 Chen et al. ..... 206/591
5,979,659 A * 11/1999 Kataoka ..... 206/588
6,257,412 B1 * 7/2001 Yamamoto et al. ..... 206/586
6,308,828 B1 * 10/2001 Jones ..... 206/583

* cited by examiner

*Primary Examiner*—Luan K. Bui
(74) *Attorney, Agent, or Firm*—Trexler, Bushnell, Giangiorgi, Blackstone & Marr, Ltd.

(57) ABSTRACT

An integral, generally rectangular corrugated fibreboard blank folds to form an insert having three air cells for cradling and protecting a product. Two of the air cells stand vertically with the third air cell suspended between them. A product rests on the third air cell and is received and captured between the vertical air cells. The insert, with the product in place, fits into a box where tabs projecting from the insert cooperates with the box to form two more air cells at the opposite ends of the inert. The specific product which prompted the invention is a toner cartridge for a printer.

18 Claims, 6 Drawing Sheets

FOLD
FOLD
FOLD
FLIP OVER

CARTRIDGE INSERT WHICH FITS INTO A BOX

This invention relates to corrugated fibreboard inserts which fit into a carton to receive and protect an elongated or generally rectangular product and more particularly—but not exclusively—to inserts which can accommodate toner or similar cartridges having any of a number of different configurations.

BACKGROUND OF INVENTION

In general, the invention is directed to packaging elongated or generally rectangular products. A moment's thought will readily bring to mind many such products such as a VCR cartridge, a glass ornament or a work of art, a portable radio, or the like. For convenience of description, all of these and other objects will hereinafter be included in the term "toner cartridge" for a computer printer.

Some fields of a product have parts which are very similar and yet are also different in detail. This means that the manufacturer of that product has often been required to inventory a different packaging system for each product in the field. This need not only increases costs for warehousing, handling, and the like, but also creates inefficiencies because the correct box may not always be available or may be in the wrong place at the wrong time.

A toner cartridge is an example of such a product. There are many manufacturers of printers which use toners in cartridges of its own design. Each manufacturer may also have a variety of toner cartridges which have evolved with improvements over the years. The same toner manufacturer may supply toner for most, if not all of these cartridges, for printers of different manufacturers. Therefore, that toner manufacturer will want to minimize the types and styles of packaging materials which it must keep in inventory, despite the fact that each printer manufacturer has its own design. The problem is further complicated since a toner cartridge does not have the smooth configuration of a rectangular box, such as a VCR cartridge.

Another consideration is the type of packaging material insofar as its bulk, ease of use, disposition and the like. For example, one type of packaging material is either molded pulp or polystyrene foam that is molded in a shape which receives and cradles a toner cartridge. Also, this requires mold tooling. It is particularly inefficient since the molded shape may not receive essentially the same cartridge if this surface contour is changed without altering the overall outer dimensions. This type of molded packaging is bulky and is costly to store and transport since it amounts to storing and shipping air. Further, it creates bulky trash for the customer to discard. In the case of polystyrene, the material is not recyclable or environment friendly.

A desirable form of packaging is a corrugated fibreboard insert because it is inexpensive, and can be stored flat to take up a minimum amount of room. It is recyclable and environmental friendly. Such an insert should be simple, easy to fold, and to interlock into place with a minimum amount of effort. Also, it should be easy for the customer to unfold and to discard it after it has done its job. Further, it should be versatile and equally easy to form and use any blank for any of many types of cartridge that may be fitted therein.

When the corrugated fibreboard blank is designed, it should use as small an amount of fibreboard as possible considering the need to physically protect the product. It should have reliably interlocking parts to keep it in an assembled condition.

SUMMARY OF THE INVENTION

Accordingly, an object of the invention is to provide a multi-purpose environmental friendly, insert which may receive and protect any one of a plurality of toner or other cartridges—or similar products—with equal protection and ease of use.

In keeping with an aspect of the invention, a corrugated fibreboard blank for receiving and protecting toner or other cartridges is designed to securely receive a product in an upright position. The product may be either wrapped or unwrapped. Different types and sizes of product may be received and protected by the way that the blank is folded before or during an insertion of product.

BRIEF DESCRIPTION OF THE DRAWINGS

The invention will become more apparent from a study of the following specification taken with the attached drawing, in which.

BRIEF DESCRIPTION OF THE INVENTION

Figure 1:
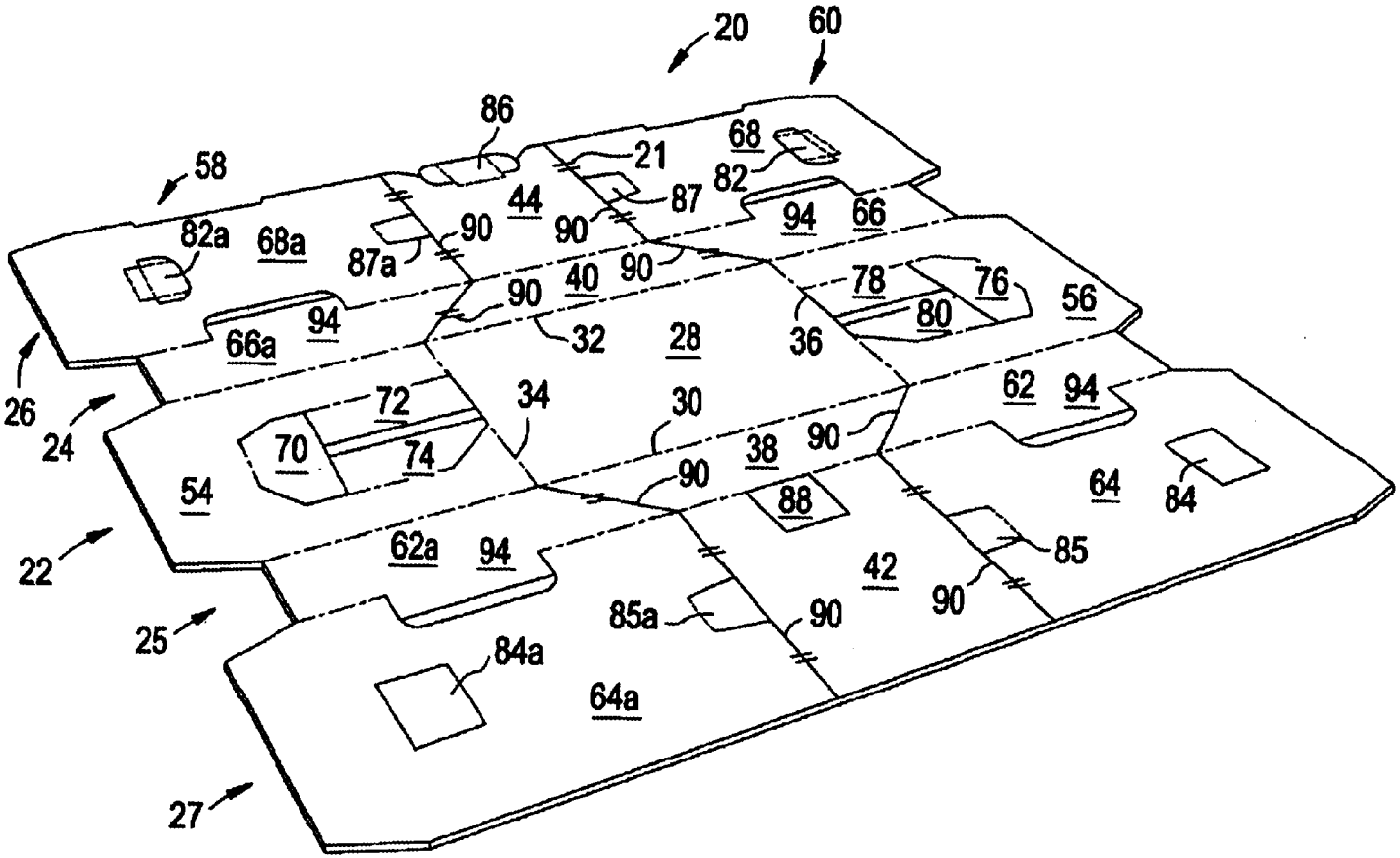
FIG. 1 is a drawing of a corrugated fibreboard blank for the inventive insert.

Briefly, the invention is directed to a corrugated fibreboard blank 20 (FIG. 1) which may be folded to form an insert for receiving and protecting a product. Dot-dashed lines show where the blank 20 folds. Solid lines show where the blank 20 is cut. Hash marks, such as shown at 21, identify lines which are partially or almost cut through, as by knicked knives, so that they will initially fold as a unit, but will break apart when the blank 20 reaches a final fold. These partially cut lines 21 divide the blank 20 into three parts which will become a central air cell having a cradle air cell on each end.

A generally rectangular and intrigally formed blank 20 is divided longitudinally into a bottom panel 22 flanked by side panels 24, 25 joined to outer panels 26, 27. The bottom panel 22 has a rectangular central bottom panel 28 with opposite sides at fold lines 30, 32 and ends 34, 36. The side panels 24, 25 have splayed panels 38, 40 joined to central bottom panel 28.

The side panels 24, 25 are joined to outer panels 26, 27 which have a bottom air cell panels 42, 44 joined to splayed panels 38, 40. The splayed panels 38, 40 and bottom air cell panels 42, 44 will fold to form an air cell below central bottom panel 28.

A central cradle panel 54, 56 is formed at each end of the central bottom panel 28. The side panels 24, 25 and the outer panels 26, 27 have intermediate and outer cradle panels 62, 64 and 66, 68, respectively, which fold to form an air cell behind the central cradle panels 54, 56. Similar cradle panels (identified by the suffix (a)) are formed on the opposite ends of outer panels 26, 27. Therefore, air cells are formed on each end and at the bottom of the insert formed by blank 20. Product anchoring tabs 70–80 are formed on the central cradle panels 54, 56.

The intermediate cradle panels 62, 66 and the outer cradle panels 64, 68 will fold to form an air cell behind the central cradle panels 54, 56. In greater detail, outer cradle panels 64, 68 fold and are positioned parallel to, behind, and spaced from central cradle panel 56. Outer cradle panels 64 and 68 are in face to face contact at which time, they are locked together when tab 82 is pushed through hole 84 and when somewhat keystone shaped tabs 85, 87 are bent into the air cell. The tab 82 has a somewhat mushroom shape to provide a handle for two fingers after it is pushed into hole 84.

The splayed panels 38, 40 and their bottom air cell panels 42, 44 are separated from intermediate cradle panels 62, 66 and from their outer cradle panels 64, 68 by lines 90 which are partially cut by knicked knives, as indicated by twin hash marks such as those shown at 21. That is to say, the corrugated fibreboard is almost, but not quite, cut through.

Three product anchor flaps 70, 72, 74, and 76, 78, 80 are formed in the central cradle panels 54, 56 on opposite ends 58, 60 of the bottom panel 22. Preferably, these anchor flaps 70–80 have irregular shape in order to accommodate different end profiles of the product packaged in the cartridge insert. In greater detail, these flaps 70–80 push out to receive and hold lower corners of the product. The opposite ends of the outer panel 26 have locking tabs 82, 82*a* which fit into holes 84, 84*a*, respectively, of the outer panel 27 in order to lock the formed air cell in place. By a selection of these irregular shapes, it is possible to design one insert to receive, say three, different cartridges.

Figure 2:
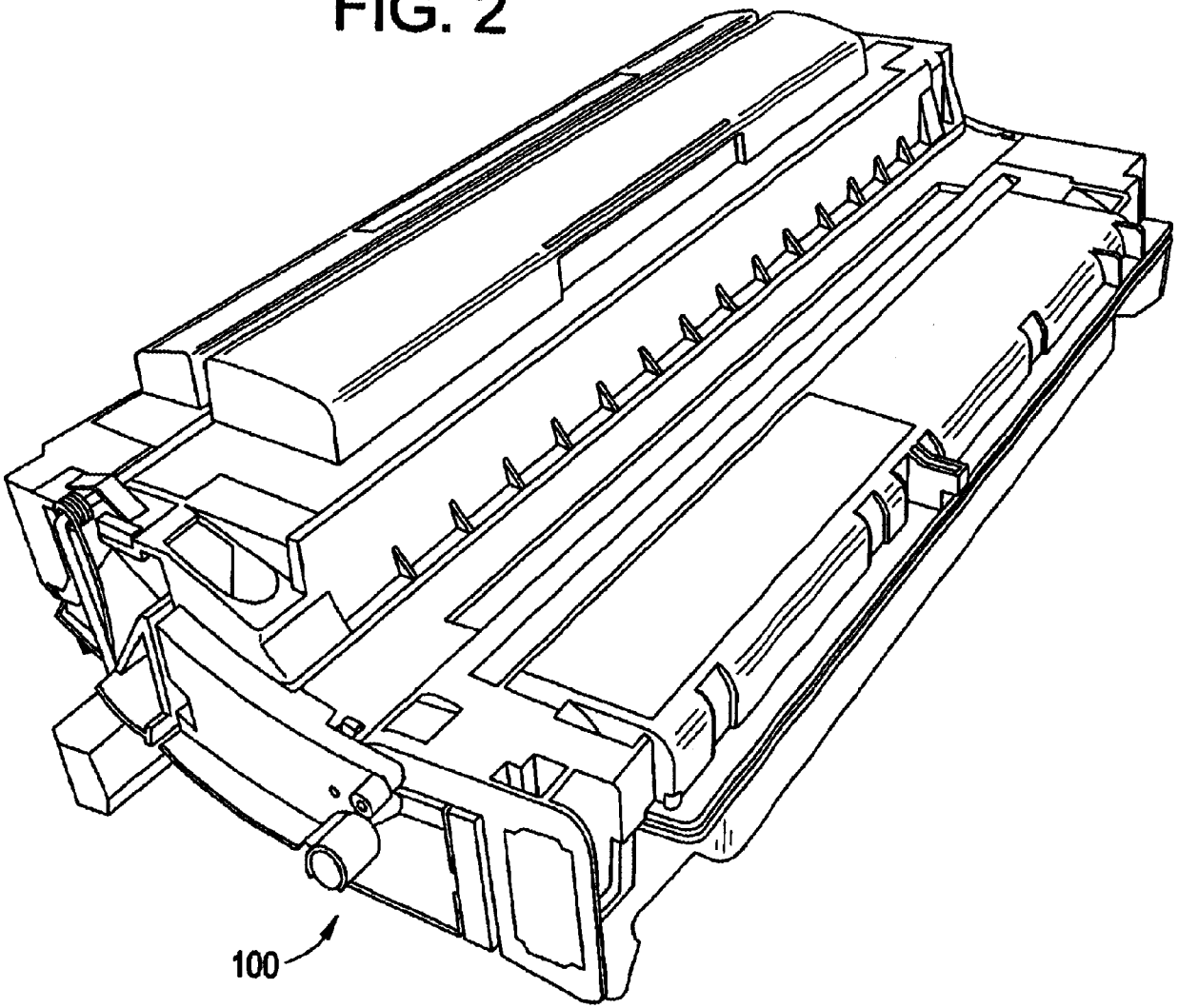
FIG. 2 is a perspective view of a toner cartridge.

FIG. 2 shows a product 100 (here shown by way of example as a toner cartridge). However, any product having a similar corner configuration may be cradled by the inventive cartridge insert. This is different from packing the product in a molded pulp or foam cradle which depends upon a cavity having the surface configuration of the product. The important feature in showing FIG. 2 is that the product has complex outside contours which can be protected without reference to these contours. The outside dimensions of the product, not the surface configuration, determines the characteristics which enable a use of the inventive insert.

Figures 3A, 3B, 3C, 3D, 3E, 3F:
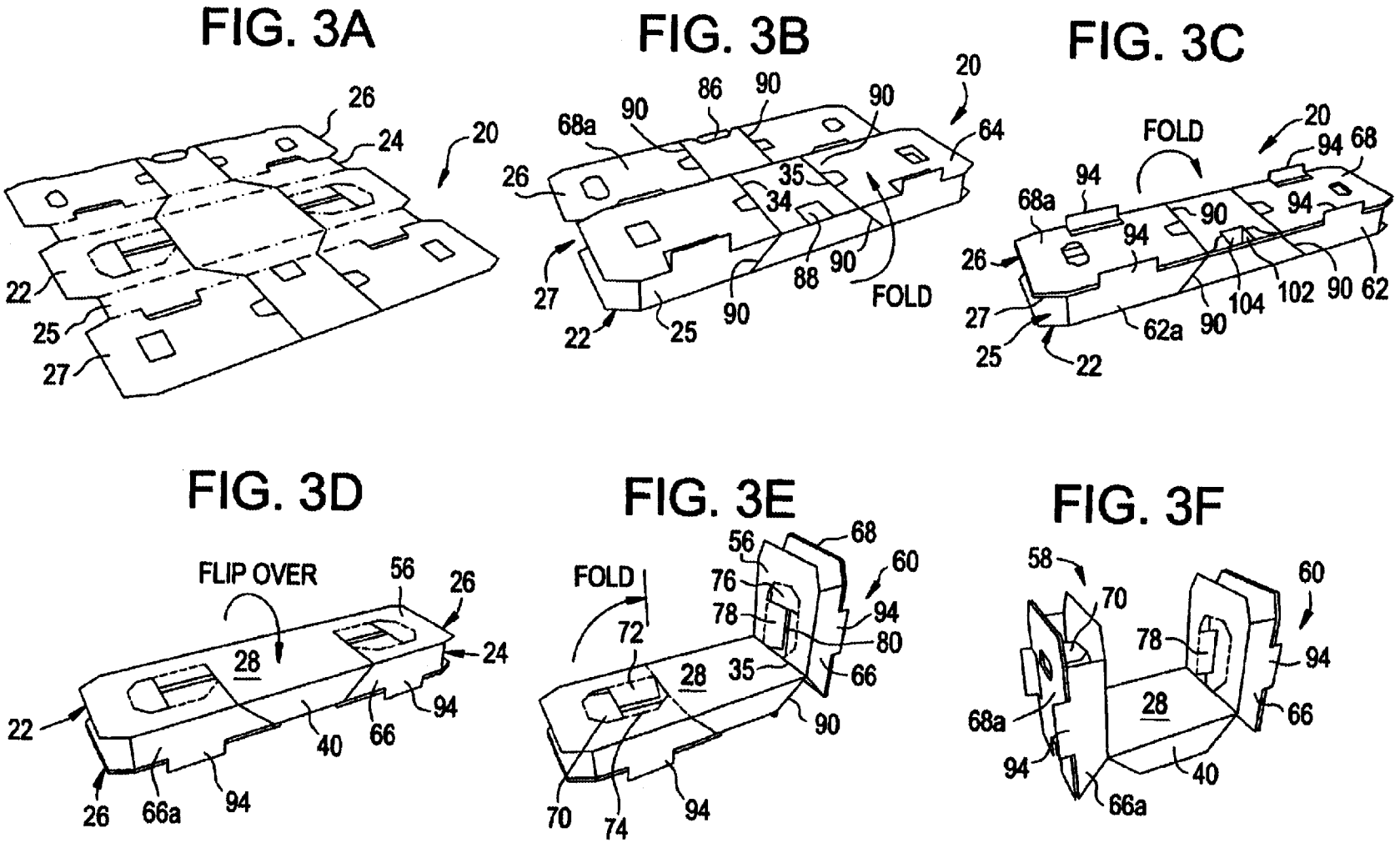
FIGS. 3A–3F are stop motion illustrating how the panels fold to form the insert.

The use of blank 20 (FIG. 3A) begins with FIG. 3B which is a first step where side panel 25 is folded to stand perpendicular to bottom panel 22. Then, outer panel 27 is folded to be parallel to bottom panel 22 and perpendicular to side panel 25.

In FIG. 3C, the side panel 24 (not seen in FIG. 3C) is folded to stand perpendicular to bottom panel 22. Outer panel 26 is folded to be perpendicular to side panel 24, parallel to and in face-to-face contact with outer panel 27 (see also FIG. 3B). Locking tab 86 is pushed into locking hole 88 to secure the blank 20 in the folded configuration of FIG. 3C. The resulting structure is a generally tubular shaped structure.

It should be noted that the spacer tabs 94 are upstanding and have not folded over with the folding of the center panels 26, 27. It should also be noted that the lines 90 which were cut partially through by a knicked knife have held together so that the panels 22–27 folded as a unit and did not break apart through the folding of FIGS. 3B and 3C.

In FIG. 3D, the blank folded in FIG. 3C is flipped over so that bottom panel 22 is on top and outer panel 26 is on the bottom. Then (FIG. 3E), the end 60 is folded up. The lines 90 partially cut by knicked knives were strong enough to remain intact during the folding and flipping of FIGS. 3B–3D, but are not strong enough to resist the folding of the air cell at end 60.

Figure 4:
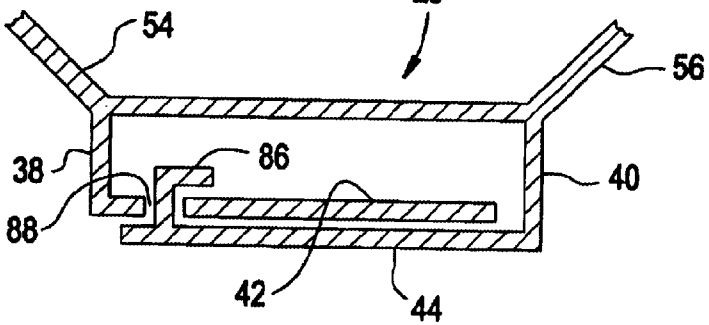
FIG. 4 is a cross section of an air cell at a bottom of the insert.

In FIG. 3F, the folding is complete when the air cell at end 58 is folded and standing approximately perpendicular to center bottom panel 28 and parallel to the air cell at end 60. As can be seen in FIG. 3F, the insert is a generally U-shaped structure when in its final form. The product anchor tabs 70–80 are pushed in, and ready to receive the product. FIG. 4 is a cross section of the air cell beneath the center bottom panel 28 which shows the locking tab 86 pressed through locking hole 88 in order to lock panels 42, 44 in an assembled position.

Figure 5:
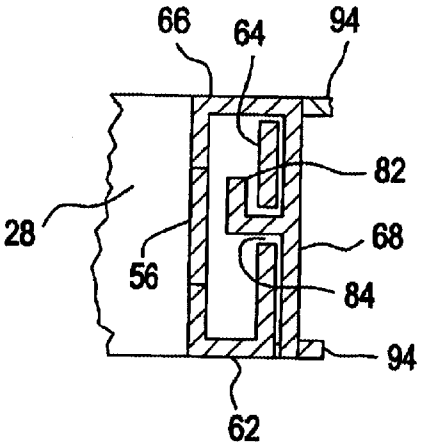
FIG. 5 is a cross section of an air cell at an end of the insert.

FIG. 5 is a cross section of the air cell formed between central cradle cell 56 and outer cradle panel 68 which shows locking tab 82 pressed through locking hole 84 to lock panels 64, 68 together.

Figure 6:
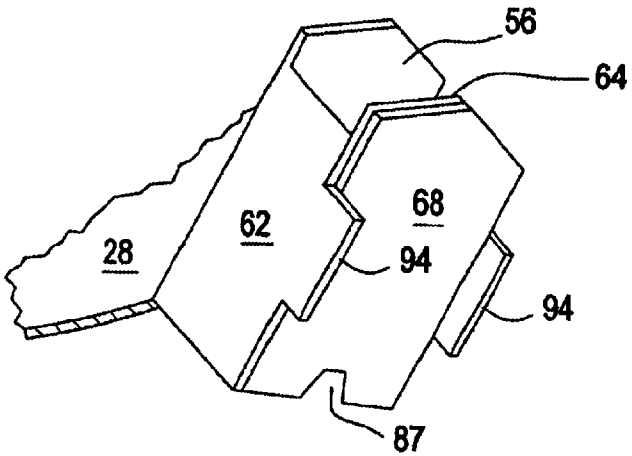
FIG. 6 is a perspective view showing an end air cell.

An air cell (FIG. 6) is formed on each end of the insert formed by folded blank 20. The bottom edges of panels 68, 64 and 68*a*, 64*a* are locked together by pushing somewhat keystone shaped panels 85, 87 and 85*a*, 87*a* inwardly (FIG. 6).

After the air cells are formed on each of the opposite ends and the bottom of the insert, the product 100 (FIG. 7) is placed on the bottom panel 28 and between the product anchor flaps 70, 72, 74 and 76, 78, 80. As the end air cells are brought together, the lower corners of the product 100 are captured as they force the anchor flaps 70–74 and 76–80 outwardly.

For toner cartridges, enclosure within a plastic bag is required by the cartridge manufacturers to avoid problems relating to the possibility of spilling ink. A plastic bag is not necessary for packaging a different type of product, which has no spillage possible.

Preferably, the toner cartridge is placed inside a plastic bag 130 (FIG. 7) when the packaging is complete. The assembled insert and product is now ready to be slid or placed in an outer box or carton.

Figure 8:
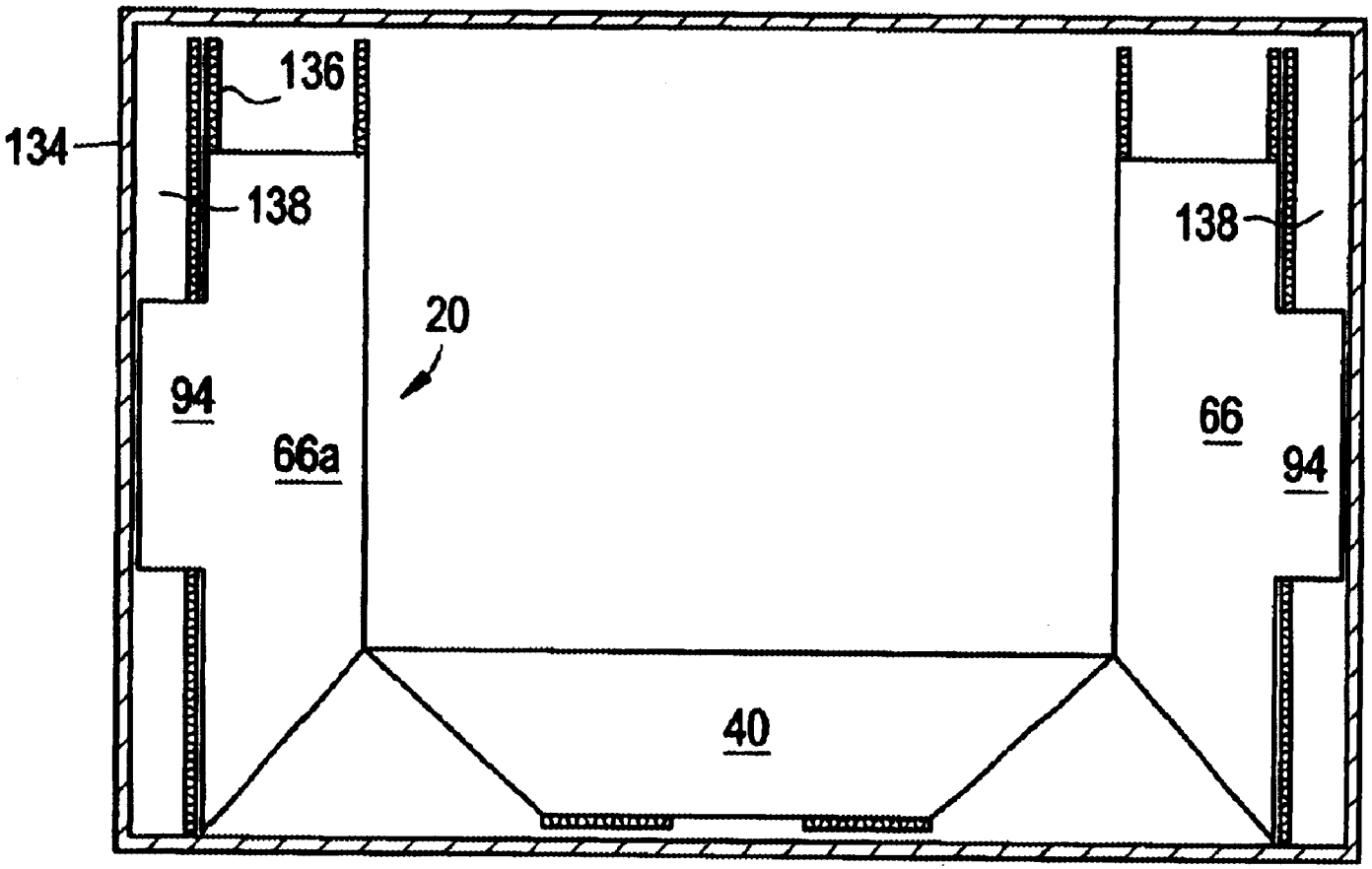
FIG. 8 is a cross section of the insert inside a box.

It should be apparent from a study of FIG. 8 that cartridges having different configurations may be accommodated since there is nothing dedicating the cartridge to specific surface shapes. Therefore, one insert may serve a family of different cartridges. In an acceptable size, the insert will be held in place by the carton or box in which the insert is used.

FIG. 8 shows a completely folded insert 20 inside an outer box or carton 134. Edges where flutes of the corrugated fibreboard may be seen are indicated, as at 136, for example. As the panels 64, 68 fold to be perpendicular to panels 62, 66, a spacer tab 94 projects outwardly as shown on panels 62, 62*a* (FIG. 3C), for example, on each side and each end of the air cell. When the insert is placed inside a box 116 or carton 134, these spacer tabs 94 rest against the inside end surfaces of the box 134, thereby forming another air cell 138 to protect the product. The splayed panel 40 of the bottom air cell is in the nature of a bridge suspended between the vertical cradle air cells identified by their side panels 66*a*, 66.

Figure 7:
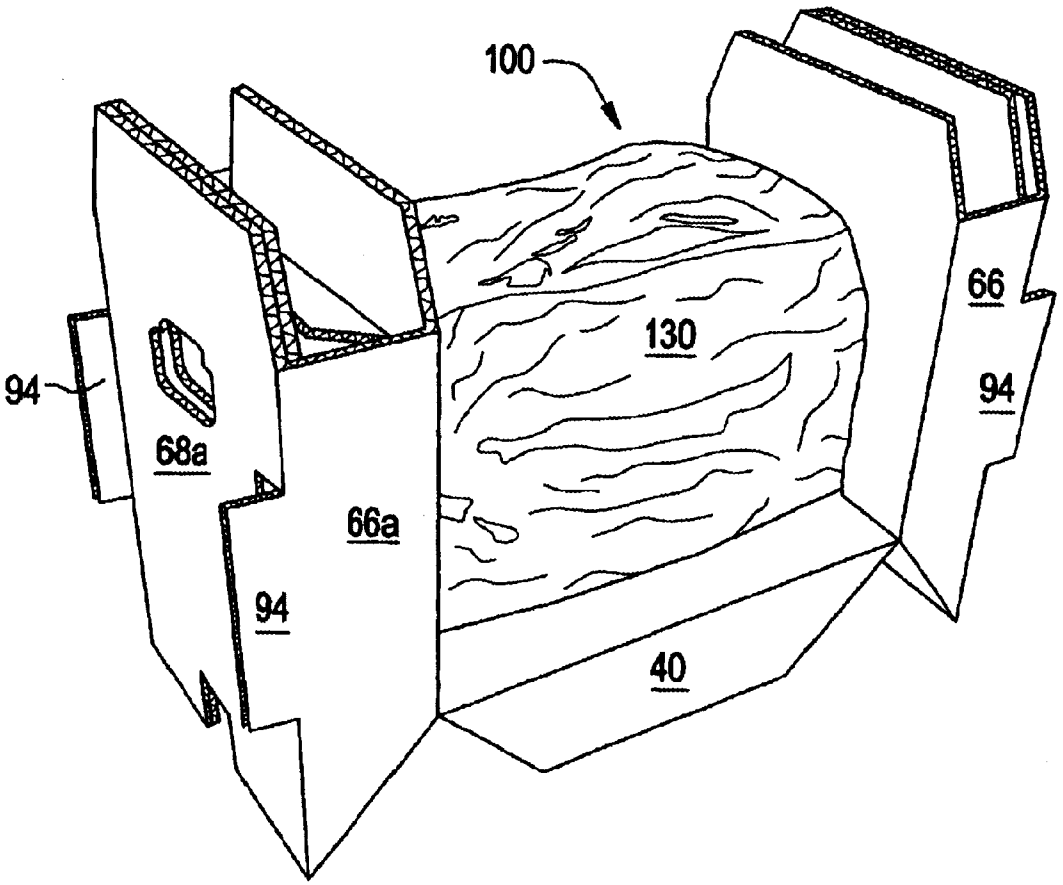
FIG. 7 is a perspective drawing of a complete insert with a plastic wrapped cartridge in place in the insert.

As shown in FIGS. 6, 7, and 8, the insert 20 is positioned to receive and cradle a product of a medium length. This particular insert fits three different cartridges of similar length, but different profiles. If the cartridge is longer or shorter, it requires a longer or shorter insert. Normally, cartridges come grouped in similar lengths.

The product anchoring tabs 70–80 (FIG. 1) provide enough relief at the bottom of the product 100 to accept a product of any suitable length which the insert can accommodate.

Those who are familiar with the packaging art will readily perceive modifications which fall within the spirit of the invention. Therefore, the following claims are to be construed to include all equivalent structures.

The claimed invention is:

1. A corrugated fibreboard insert for receiving and protecting a product, said insert comprising:

a generally rectangular blank divided longitudinally into a bottom panel flanked by side panels joined to outer panels;

said bottom panel having a rectangular central bottom panel having opposite sides and ends;

said side panels having splayed panels joined to said opposite sides of said central bottom panel;

said outer panels having bottom air cell panels joined to said splayed panels;

said splayed panels and said bottom air cell panels folding to form an air cell below said central bottom panel;

central cradle panels joined to opposite ends of said central bottom panel;

said side panels and said central cradle panels having intermediate and outer cradle panels which fold to form an air cell behind each of said central cradle panels;

whereby air cells are formed on each end and a bottom of said insert; and product anchoring tabs on each of said central cradle panel.

2. The insert of claim 1 wherein said blank is cut partially through to separate the splayed and bottom air cell panels from the intermediate and over cradle panels.

3. The insert of claim 1 further comprising somewhat mushroom shaped anchor tabs on at least one of said panels for locking said panels in place by being pushed into an opening on another of said panels, the dimensions of an opening after said anchor tab is pushed being large enough to form a handle which may be gripped by at least one finger.

4. The insert of claim 3 and spacer tabs formed at opposite ends of said insert to form an air cell between said insert and an outer box in which said insert may be packed.

5. An insert for receiving, cradling, and protecting a product, said insert comprising:

a corrugated fibreboard blank divided by fold and cut lines to enable the blank to be folded into a cradle configuration said folding forming a bottom panel over an associated air cell and a pair of vertical cradle panels with an associated air cell on each end of said bottom panel, said bottom air cell being a bridge suspended between said pair of vertical cradle air cells; and product anchoring tabs on said pair of vertical panels for securing a product in place between said vertical panels and said bottom air cell.

6. The insert of claim 5 wherein said vertical cradle panels and their associated air cells fold slightly outwardly or inwardly relative to said bottom air cell in order to adjust to different lengths of the product.

7. The insert of claim 6 and an outer box for receiving said insert and for fixing a distance between the outwardly or inwardly folded vertical cradle panels.

8. The insert of claim 5, wherein said insert is formed and stabilized into said cradle configuration by use of only said blank.

9. The insert of claim 5, wherein said associated air cell of said bottom panel is bounded at a top thereof by said bottom panel and is bounded at a bottom thereof by a portion of said corrugated fibreboard blank.

10. The insert for receiving, cradling, and protecting a product, said insert comprising:

a corrugated fibreboard blank divided by fold and cut lines to enable the blank to be folded into a cradle configuration;

said folding forming a bottom panel over an associated air cell and a pair of vertical cradle panels with an associated air cell on each end of said bottom panel, said bottom air cell being a bridge suspended between said pair of vertical cradle cells, said vertical cradle panels and their associated air cells fold slightly outwardly or inwardly relative to said bottom air cell in order to adjust to different lengths of the product;

product anchoring tabs on said pair of vertical panels for securing a product in place within said cradle configuration;

an outer box for receiving said insert and for fixing a distance between the outwardly or inwardly folded vertical cradle panels; and spacer tabs on each of said vertical cradle panel adjacent air cells for forming additional air cells between said adjacent air cell and an end wall of said outer box.

11. A corrugated fibreboard blank for forming a structure to receive and protect a toner cartridge for a printer, said structure being formed by folding an integral generally rectangular corrugated fibreboard blank in order to form a cradle configuration for receiving ends and for supporting a bottom surface of the toner cartridge;

said cradle being formed of three integrally formed air cells, which are joined to provide two end cells and a central cell suspended between said two end cells;

said central air cell having a bottom panel for supporting the bottom surface of the toner cartridge; and said two end air cells having anchoring flaps which receive opposite ends of the toner cartridge.

12. The insert of claim 11 wherein said corrugated fibreboard blank is divided by fold and cut lines to enable the integral blank to be folded into the structure;

said folding forming a said bottom panel over said central air cell and a vertical cradle panel for each of said two end air cells, said adjacent vertical cradle panels being joined to opposite ends of said bottom panel, respectively; and said anchoring flaps being on said vertical panel for securing said ends of the toner cartridge in place within the structure.

13. A blank for cradling a product, said blank comprising:

a longitudinal bottom panel flanked by side panels joined to outer panels;

said longitudinal bottom panel having opposite ends with a central cradle panel joined to and extending from each of said opposite ends of said longitudinal bottom panel;

each of said side panel comprises a centrally located splayed panel positioned between outer portions of said side panel, said centrally located splayed panel connected to a side of said longitudinal bottom panel, each of said outer panel having a centrally located bottom air cell panel joined to and extending from said splayed panel;

an outer cradle panel connected to each of said outer portions of each said side panels and adjacent said bottom air cell panels; and a partially cut line extending from each corner of said longitudinal bottom panel and defining boundaries between said splayed panels and said outer portions of each said side panel and between each said bottom air cell panel and each said outer cradle panel.

14. The blank of claim 13 and product anchor tabs on each said central cradle panel.

15. The blank of claim 13 wherein said bottom, side and outer panels are defined by fold lines, said side panels folding perpendicular to said bottom panel and said outer panels folding into face to face contact over said bottom panel thereby forming a tubular structure.

16. The blank of claim 15 wherein said partially cut lines divide said tubular structure into three parts.

17. The blank of claim 16 wherein said partially cut lines enable said folding of said blank into said tubular structure.

18. The blank of claim 17 wherein said cut lines break apart responsive to folding said tubular stricture into a somewhat U-shaped structure.

* * * * *

UNITED STATES PATENT AND TRADEMARK OFFICE

CERTIFICATE OF CORRECTION

PATENT NO. : 6,685,025 B1
DATED : February 3, 2004
INVENTOR(S) : David F. Kari

It is certified that error appears in the above-identified patent and that said Letters Patent is hereby corrected as shown below:

Column 8,
Line 6, “stricture” should read -- structure --

Signed and Sealed this

Thirteenth Day of April, 2004

JON W. DUDAS
*Acting Director of the United States Patent and Trademark Office*